US005098084A

United States Patent [19]

Culver

[11] Patent Number: 5,098,084

[45] Date of Patent: Mar. 24, 1992

[54] ARTIFICIAL SNOW DEFLECTOR

[76] Inventor: Philip H. Culver, 7801 Holiday Dr., Sarasota, Fla. 34231

[21] Appl. No.: 607,256

[22] Filed: Oct. 31, 1990

[51] Int. Cl.[5] ..... A63J 5/02

[52] U.S. Cl. ..... 272/15; 40/410

[58] Field of Search ..... 272/6, 15, 22 B, 8 R, 272/8 N; 40/410, 430, 409, 431, 435, 502; 47/23

[56] References Cited

U.S. PATENT DOCUMENTS

| | | | |
|---|---|---|---|
| 901,319 | 10/1908 | Bruen | 272/15 |
| 3,147,175 | 9/1964 | Gonzalez | 272/15 X |
| 3,415,512 | 12/1968 | Burnbaum . | |
| 3,415,513 | 12/1968 | Burnbaum . | |
| 3,905,140 | 9/1975 | Damiano | 272/15 X |
| 4,028,830 | 6/1977 | Ottinger . | |
| 4,076,234 | 2/1978 | Burnbaum . | |
| 4,962,922 | 10/1990 | Chu | 272/15 |

*Primary Examiner*—Richard E. Chilcot, Jr.

*Attorney, Agent, or Firm*—Charles J. Prescott

[57] ABSTRACT

A deflector for artificial snow upwardly discharged from the upper end of a delivery tube which extends along substantially the entire length of the trunk of a tree. A blower is positioned at the base of the tree within a catch basin containing and recollecting artificial snow which is fed by gravity to the blower inlet. The blower outlet supplies artificial snow into the lower end of the delivery conduit. A deflector includes upper and lower dome-shaped discs connected in spaced apart relation to form a downwardly disposed artificial snow discharge slot therebetween. An artificial snow dispersing element connectable to the upper end of the delivery conduit is itself connected to the upper disc and downwardly extends through a central snow discharge aperture in the lower disc. By this arrangement, artificial snow is uniformly dispersed to fall over the tree from the discharge slot and the discharge aperture.

12 Claims, 1 Drawing Sheet

ARTIFICIAL SNOW DEFLECTOR

BACKGROUND OF THE INVENTION

This invention generally relates to apparatus for cascading artificial snow downward by gravity over the branches of a decorative tree, and more particularly to a deflector of the artificial snow positioned at the top of the tree for more uniform dispersion of the artificial snow.

Several prior art devices are known to applicant. Burnbaum holds three separate U.S. Pat. Nos. 3,415,512, 3,415,513 and 4,076,234 which are directed to artificial snow apparatus for decorative trees such as Christmas trees. The '512 patent is directed to an overall artificial snow apparatus for Christmas trees which includes a conical-shaped deflector. The '513 patent is directed to the vibratory movement of the blower against the collecting receptacle, the system including a deflector having an inverted cone-shaped deflector element located in the path of the upwardly discharged artificial snow.

The '234 Burnbaum patent is directed to a uniquely-shaped, self-sealing conical artificial snow collecting receptacle, this invention also disclosing a downwardly oriented conical-shaped deflector.

Another invention to Ottinger disclosed in U.S. Pat. No. 4,028,830 teaches a unique intake conduit assembly having an intermediate exterior air inlet for collecting artificial snow within the catch basin for conveyance to the blower and also includes an upwardly oriented arcuate, concave, fluted deflector for dispersing the artificial snow over the tree.

The present invention provides for a unique dome-shaped artificial snow deflector for use in conjunction with an apparatus for continuously cascading artificial snow over the branches of a decorative tree. The deflector of the present invention more uniformly disperses the artificial snow than other prior art devices known to applicant.

BRIEF SUMMARY OF THE INVENTION

This invention is directed to a deflector for artificial snow upwardly discharged from the upper end of a delivery tube which extends along substantially the entire length of the trunk of a tree. A blower is positioned at the base of the tree within a catch basin containing and recollecting artificial snow which is fed by gravity to the blower inlet. The blower outlet supplies artificial snow into the lower end of the delivery conduit. A deflector includes upper and lower dome-shaped discs connected in spaced apart relation to form a downwardly disposed artificial snow discharge slot therebetween. An artificial snow dispersing element connectable to the upper end of the delivery conduit is itself connected to the upper disc and downwardly extends through a central snow discharge aperture in the lower disc. By this arrangement, artificial snow is uniformly dispersed to fall over the tree from the discharge slot and the discharge aperture.

It is therefore an object of this invention to provide an improved artificial snow deflector for use with apparatus for downwardly cascading artificial snow over a decorative tree, the snow falling from the deflector by gravity.

In accordance with these and other objects which will become apparent hereinafter, the instant invention will now be described with reference to the accompanying drawings.

DETAILED DESCRIPTION OF THE INVENTION

Figure 2:
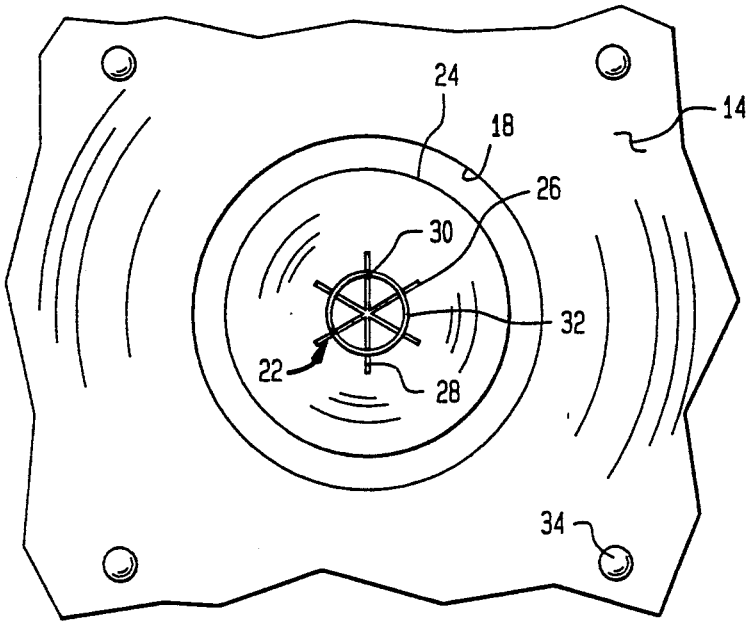
FIG. 2 is a partial bottom plan view in the direction of arrows 2—2 in FIG. 1.
Figure 1:
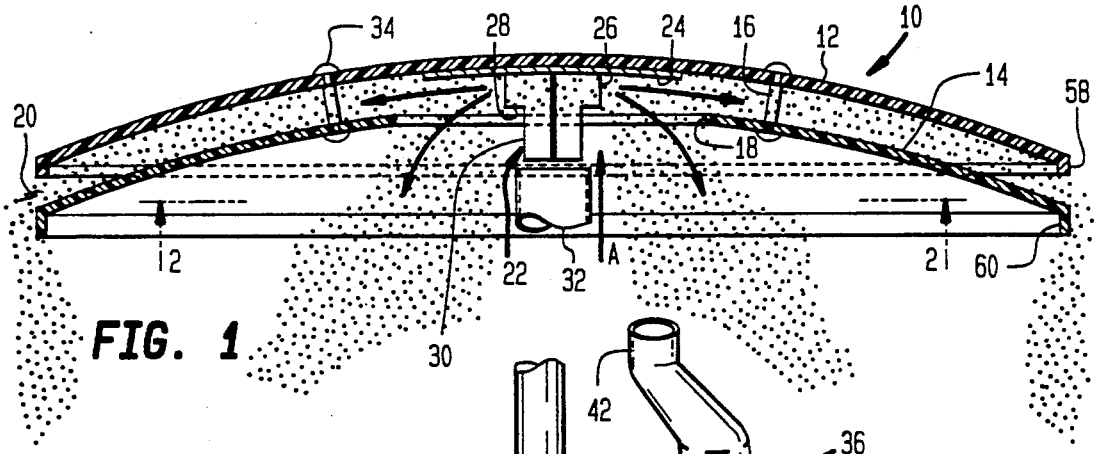
FIG. 1 is a side elevation section view through the center of the invention.

Referring now to the drawings, the preferred embodiment of the deflector of the present invention is shown generally at numeral 10. This deflector 10 includes upper and lower dome-shaped discs 12 and 14 which are spaced apart and held connected in the relationship shown by spacers 16 and conventional rivets or screws 34. This arrangement defines a disc-shaped passageway between the two discs 12 and 14 ending in a circular peripheral discharge slot 20 therebetween.

The lower dome 14 includes a circular discharge aperture 18 centrally positioned as shown. An artificial snow dispersing element 22 is connected to plate 24 which, in turn, is connected to the lower central surface of upper disc 12. The dispersing element 22 is formed of a plurality of thin, upright, radially extending vanes 26 which downwardly extend through discharge aperture 18 in lower disc 14. These vanes 26 are uniformly spaced through 360°. The vanes 26 are also notched at 30 to a uniform width so as to define a cylindrical upright outer surface. This imaginary cylindrical surface defined by notches 30 is sized so as to receive the upper end of a delivery conduit 32 fitted upwardly in the direction of arrow A thereover.

To prevent the upper end of the delivery tube 32 from fully extending to cover the entire length of vanes 26, surface 28 of notch 30 on each vane 26 is also provided. By this arrangement, then, artificial snow discharging upwardly out from delivery tube 32 in the direction of the arrow will strike plate 24 and then flow radially outwardly and downwardly in the direction of the arrows through discharge slot 20 and through discharge aperture 18, respectively.

The peripheral margins 58 and 60 of each disc 12 and 14 are down-turned to assist in more uniformly dispersing artificial snow from discharge slot 20. Preferably, both discs 12 and 14 have an identical shape as shown.

Figure 3:
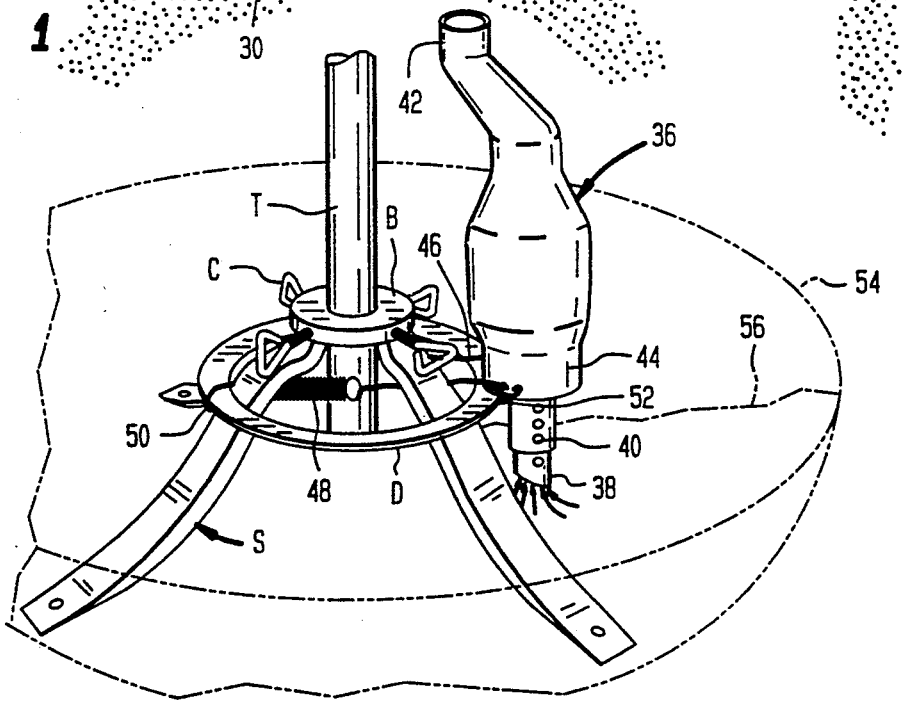
FIG. 3 is a perspective view of the lower tree trunk and support stand connected to the artificial snow blower within a catch basin shown in phantom.

Referring particularly to FIG. 3, an in-line blower 36 is provided having an outlet 42 and a taper-cut inlet or pickup tube 38. The blower 36 is releasably connected to the central tray D of a conventional tree stand S by coil springs 48. One end 46 of each spring 48 is connected to eyelets in the lower housing area of blower 36, while the other looped end 50 of each spring 48 is connected to the opposing rim of the central tray D. A bracket 52 connected to and horizontally extending from blower 36 engages the lip of the tray D so as to cooperate with the tension provided by springs 48 to support blower 36 in its upright orientation.

A catch basin 54 (shown in phantom) is structured to include a quantity of artificial snow, the upper level of which is shown in phantom at 56. This upper level 56 is above the lower end of inlet 38 so that blower 36 will draw artificial snow into inlet 38 in the direction of the arrows. A plurality of apertures 40 are also provided for the introduction of air into blower 36. An additional aperture 44 is also provided which may be made adjustable in size for additional air intake so as to control the volume of artificial snow drawn into blower 36. Outlet 42 is sized to snugly engage within the lower end of delivery conduit 32 so as to deliver the artificial snow upwardly into and against the dispersing element 22 as previously described.

The preferred embodiment of the artificial snow utilized in the present invention is in the form of small Styrofoam beads having a general diameter of 1/16th to ⅛th inch.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A deflector for artificial snow being continuously circulated upwardly through a delivery conduit extending along a tree trunk by a blower means positioned at the base of the tree within a catch basin containing a quantity of artificial snow, said deflector comprising;

an upper and lower dome-shaped disc connected in spaced apart relation to form a downwardly disposed artificial snow discharge slot between the peripheral margins of each said disc;

an artificial snow dispersing element connected to the lower central surface of said upper disc and downwardly extending through an artificial snow discharge aperture formed through the central portion of said lower disc;

said dispersing element structured for connection with the upper end of said delivery conduit and for outwardly and downwardly deflecting artificial snow supplied from said delivery conduit between said upper and lower discs out said discharge slot and downwardly through said discharge aperture, respectively.

2. A deflector as set forth in claim 1, wherein:

said dispersing element includes a plurality of generally uniformly radially extending upright thin rigid vanes connected to and downwardly extending from said upper disc through said discharge aperture of said lower disc;

said plurality of vanes having upright distal edges which define a cylindrical surface over which the upper end of said delivery tube slidably engages toward, but not to, said upper disc.

3. A deflector as set forth in claim 2, wherein:

said upper disc peripheral margin is downwardly extending toward, but not to, said lower disc.

4. A deflector as set forth in claim 3, wherein:

the shape of said upper and lower discs is substantially identical one to another.

5. In an apparatus for continuously cascading by gravity artificial snow down onto and through branches of a tree, said apparatus including a blower means having an inlet and an outlet and positioned within a catch basin at the base of the tree, said catch basin for collecting and delivering artificial snow to said inlet, a delivery conduit extending from said outlet upwardly to the top of the tree for discharging artificial snow upward against a deflector positioned above said delivery conduit, the improvement comprising:

said deflector including an upper and lower dome-shaped disc connected in spaced apart relation to form a downwardly disposed artificial snow discharge slot between the peripheral margins of each said disc;

an artificial snow dispersing element connected to the lower central surface of said upper disc and downwardly extending through an artificial snow discharge aperture formed through the central portion of said lower disc;

said dispersing element structured for connection with the upper end of said delivery conduit and for outwardly and downwardly deflecting artificial snow supplied from said delivery conduit between said upper and lower discs out said discharge slot and downwardly through said discharge aperture, respectively.

6. An apparatus as set forth in claim 5, wherein:

said dispersing element includes a plurality of generally uniformly radially extending upright thin rigid vanes connected to and downwardly extending from said upper disc through said discharge aperture of said lower disc;

said plurality of vanes having upright distal edges which define a cylindrical surface over which the upper end of said delivery tube slidably engages toward, but not to, said upper disc.

7. An apparatus as set forth in claim 5, wherein:

said upper disc peripheral margin is downwardly extending toward, but not to, said lower disc.

8. An apparatus as set forth in claim 5, wherein:

the shape of said upper and lower discs is substantially identical one to another.

9. An apparatus for continuously cascading by gravity artificial snow down onto and through the branches of a tree held within a tree stand comprising:

a blower having an inlet and an outlet connectable to the tree stand;

a catch basin positionable around the base of the tree structured to collect the cascading artificial snow and to deliver it by gravity into said blower inlet;

a delivery conduit connected at its lower end to said blower outlet and extending upwardly along the trunk of the tree for discharging artificial snow upwardly against and for supporting a deflector positioned at the top of the tree;

said deflector including an upper and lower dome-shaped disc connected in spaced apart relation to form a downwardly disposed artificial snow discharge slot between the peripheral margins of each said disc;

an artificial snow dispersing element connected to the lower central surface of said upper disc and downwardly extending through an artificial snow discharge aperture formed through the central portion of said lower disc;

said dispersing element structured for connection with the upper end of said delivery conduit and for outwardly and downwardly deflecting artificial snow supplied from said delivery conduit between said upper and lower discs out said discharge slot and downwardly through said discharge aperture, respectively.

10. An apparatus as set forth in claim 9, wherein:

said dispersing element includes a plurality of generally uniformly radially extending upright thin rigid vanes connected to and downwardly extending from said upper disc through said discharge aperture of said lower disc;

said plurality of vanes having upright distal edges which define a cylindrical surface over which the upper end of said delivery tube slidably engages toward, but not to, said upper disc.

11. A deflector as set forth in claim 9, wherein:

said upper disc peripheral margin is downwardly extending toward, but not to, said lower disc.

12. A deflector as set forth in claim 9, wherein:

the shape of said upper and lower discs is substantially identical one to another.

* * * * *